US009757800B2

(12) United States Patent
Eagens

(10) Patent No.: US 9,757,800 B2
(45) Date of Patent: Sep. 12, 2017

(54) TRANSPORTATION OF CASTINGS PRODUCED IN AND STILL ENCAPSULATED IN ITS GREEN SAND MOLD PRODUCING ENHANCED CASTING COOLING AND PROCESSED SAND PROPERTIES WITH SUBSEQUENT HIGH VELOCITY CONTROLLED AIR COOLING OF THE CASTINGS

(71) Applicant: Jeffrey D. Eagens, Rocky River, OH (US)

(72) Inventor: Jeffrey D. Eagens, Rocky River, OH (US)

( * ) Notice: Subject to any disclaimer, the term of this patent is extended or adjusted under 35 U.S.C. 154(b) by 50 days.

(21) Appl. No.: 14/423,647

(22) PCT Filed: Aug. 26, 2013

(86) PCT No.: PCT/US2013/056648
§ 371 (c)(1),
(2) Date: Feb. 24, 2015

(87) PCT Pub. No.: WO2014/032045
PCT Pub. Date: Feb. 27, 2014

(65) Prior Publication Data

US 2015/0209862 A1 Jul. 30, 2015

Related U.S. Application Data

(60) Provisional application No. 61/692,972, filed on Aug. 24, 2012.

(51) Int. Cl.
*B22D 29/00* (2006.01)
*B22D 46/00* (2006.01)
(Continued)

(52) U.S. Cl.
CPC ..... *B22D 46/00* (2013.01); *B22D 29/00* (2013.01); *B22D 29/006* (2013.01); *B22D 30/00* (2013.01); *C21D 9/0056* (2013.01)

(58) Field of Classification Search
CPC ..... B22D 29/00; B22D 29/006
(Continued)

(56) References Cited

U.S. PATENT DOCUMENTS 5,294,094 A * 3/1994 Crafton ..... B22D 31/002 164/132
5,505,247 A * 4/1996 Musschoot ..... B22D 30/00 164/131
(Continued)

FOREIGN PATENT DOCUMENTS

EP 2 319 945 B1 5/2013

OTHER PUBLICATIONS

PCT/US2013/056648, "International Search Report and Written Opinion", dated Jan. 14, 2014.

*Primary Examiner* — Kevin E Yoon
(74) *Attorney, Agent, or Firm* — Fay Sharpe LLP

(57) ABSTRACT

In accordance with one aspect of the present embodiment, disclosed is a system and method of processing sand mold castings including the steps of placing a mold on a translation surface of a first conveyor at a first position, the mold including a sand housing having compacted sand that encapsulates a casting. The mold is translated along the translation surface of the first conveyor from the first position towards a second position. Air is directed against the casting and temperature of the air and or casting is measured after the casting is being removed from the sand mold.

16 Claims, 7 Drawing Sheets

(51) Int. Cl.
*B22D 30/00* (2006.01)
*C21D 9/00* (2006.01)

(58) Field of Classification Search
USPC ..... 164/131, 132
See application file for complete search history.

(56) References Cited

U.S. PATENT DOCUMENTS 5,551,998 A * 9/1996 Crafton ..... B22D 31/002 148/538
5,957,188 A * 9/1999 Crafton ..... B22C 5/085 164/132
8,066,053 B2 * 11/2011 Lewis, Jr. ..... B22D 29/00 164/131
2009/0206527 A1 8/2009 Crafton et al.

* cited by examiner

TRANSPORTATION OF CASTINGS PRODUCED IN AND STILL ENCAPSULATED IN ITS GREEN SAND MOLD PRODUCING ENHANCED CASTING COOLING AND PROCESSED SAND PROPERTIES WITH SUBSEQUENT HIGH VELOCITY CONTROLLED AIR COOLING OF THE CASTINGS

This national stage application is a submission under 35 U.S.C. 371 of PCT International Patent Application No. PCT/US2013/056648, filed on 26 Aug. 2013, and claims the priority benefit of U.S. Provisional Application No. 61/692,972, filed on Aug. 24, 2012, the disclosures of which are incorporated herein by reference.

BACKGROUND

The present exemplary embodiment relates to a manufacturing process and system. It finds particular application in conjunction with processing sand type molds, and will be described with particular reference thereto. However, it is to be appreciated that the present exemplary embodiment is also amenable to other like applications.

Many types of manufacturing processes utilize sand molds to assist with the heat transfer required to manufacture work pieces from molten material such as iron. The basic steps of a sand molding process include placing a desired pattern in the sand to create a mold half, compress the sand and pattern into a gating system, remove the pattern, align the mold halves together to create a mold cavity, fill the mold cavity with molten material, and allow the material to cool and break away the sand mold to remove the casting.

More particularly, the known processes manufacture particular types of castings and various processes with particular features are employed depending on the requirements of the finished part or workpiece. For instance, vertical flaskless molding processes are employed to generate round and geometric shaped workpieces. Vertical flaskless molding is the process whereby sand molds are generated and stacked together horizontally along an elongated in-line process. Contact surfaces of each mold are vertically aligned and abut one another. Molten material, such as iron, is poured into a vertical joint of the mold halves whereby the material is allowed to harden, the sand mold is removed, and the workpiece is generated. A table or surface supports the molds on a common horizontal plane as a machine makes each mold half. The table includes particular features that are configured to allow the contact surfaces of each mold to maintain mold-to-mold contact pressure of each mold along the entire line such that molten material does not leak therefrom and until the material solidifies as intended.

Additionally, horizontal tight flask molding is utilized for thin longer and flatter work pieces. The horizontal tight flask molding process utilizes sand molds that are created and designed to stack together horizontally in a signal set. The contact surfaces of the mold halves align and abut horizontally in this process. Molten material is poured into the top mold half as the mold halves are formed in and maintained in a housing such as a steel "flask".

Many types of conveyors are used to heat or cool the sand molds and work pieces. Conventional conveyors of different lengths and configurations translate the workpieces while directing air across the workpieces. Other foundry type conveyors that are generally known include U.S. Pat. No. 7,296,951 to Kraus et al., as well as U.S. Pat. Nos. 6,827,201, 7,037,048 and 7,377,728 to Markowski et al. each of which are incorporated herein by reference.

However, these processes address covered transporting molds with castings, and castings only, but have not addressed the problematic issue of actually measuring the temperature of the castings after being removed from the sand mold and applying a cooling method that automatically adjusts the amount of air, or high velocity air, that is applied to efficiently lower the temperature of the casting to a desired temperature for subsequent processing, e.g., degating and shot blast cleaning.

BRIEF DESCRIPTION

One aspect of the present exemplary embodiment is a method of processing sand mold castings including the steps of placing a mold on a translation surface of a first conveyor at a first position (e.g., an upstream position), the mold including a sand housing having compacted sand that encapsulates a casting. The mold is translated along the translation surface of the first conveyor from the first position towards a second position (e.g., a downstream position). Air is directed against the casting and a temperature of the air and/or temperature of the casting is (are) measured after the casting is removed from the sand mold.

Still other features and benefits of the present disclosure will become apparent from the following detailed description.

DETAILED DESCRIPTION

A method and system is provided for a transportation of a mold casting while the casting is still in a sand mold, and as the sand mold is subsequently removed from the external surface of the cast component. Additionally, a process for transporting and cooling mold castings with high velocity air flow is provided.

The method and apparatus used for this disclosure uses a series of conveyors to transport the molds for the duration required for cooling of the casting in the sand mold. The use of a series of conveyors produces maximum heat transfer from the casting to the molding sand. A unique feature of this process is that the system and process combine the transportation of the casting in the mold and also allows for the sand that is shed from the mold (due to thermal degradation and vibratory friction) to be maintained as a carrying media for the casting. The system also incorporates means for removal of the sand from the mold at a temperature below the eutectic state of the casting solidification and then subsequent high velocity controlled air cooling of the castings in the same process line system.

Figure 1:
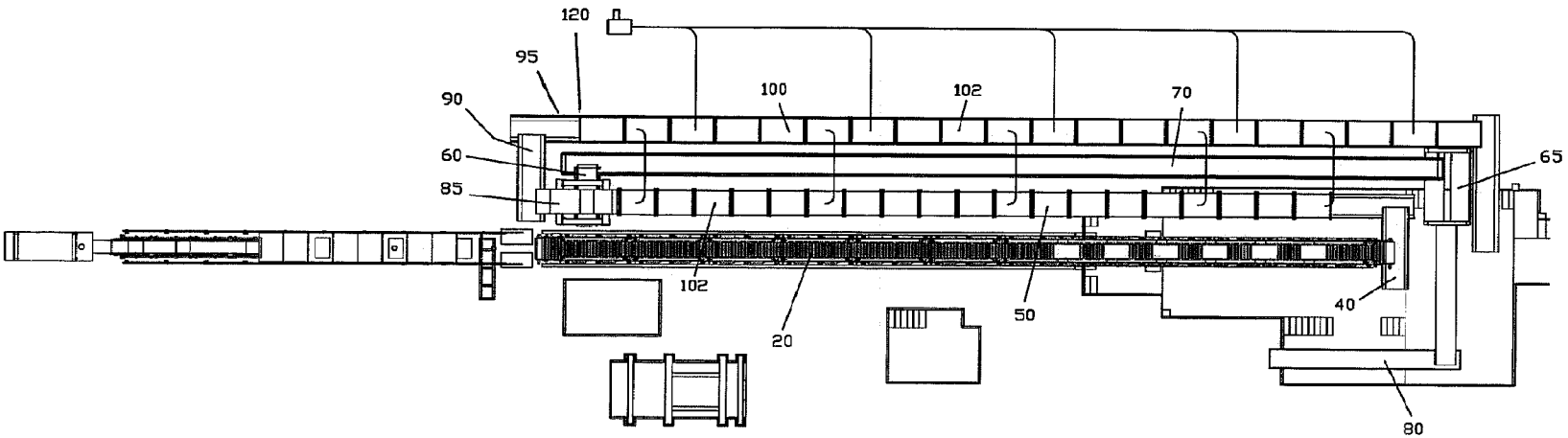
FIG. 1 is a schematic plan view of a preferred method and system for processing sand mold castings according to the present disclosure.

This method uses conveyors of specific calculated lengths and flow rates to transport the castings and molds to maximize the amount of heat transfer from the casting to the sand from the mold. Initially, molds are formed, aligned and filled with molten material. As illustrated by FIG. 1, the molds are translated along a conveyor 20 until the molten material is sufficiently solid.

Once this is accomplished the molds are transferred to a vibration conveyor at location 40 to begin imposing a vibration force to the mold to impose shedding of loose sand from the mold. The molds extend along the conveyor and are subject to vibration along all or a part of this accumulating mold conveyor 50. The accumulating mold conveyor 50 translates the molds through a series of high velocity exhaust hoods 102 that are adapted to receive a pressurized air flow or velocity of air from a casting cooling conveyor 100 downstream of the accumulating mold conveyor 50. Preferably, the sand is further shed and removed from the mold along the accumulating mold conveyor 50 wherein the sand is collected in a sand transfer conveyor 60 and transported to a sand hopper 65 via a sand return conveyor 70. The sand is then sent from the hopper 65 to a reprocessing center (not shown) via a sand return conveyor 80. In one embodiment, the molds can be conveyed over a shakeout deck or frequency conveyor 85 that is configured to further shed sand from the casting and collect sand on the sand transfer conveyor 60. The accumulating mold conveyor 50 terminates in a housing 95 that preferably contains the frequency conveyor 85 and sand transfer conveyor 60. The sand return conveyor 70 extends from the housing unit 95.

Figure 2:
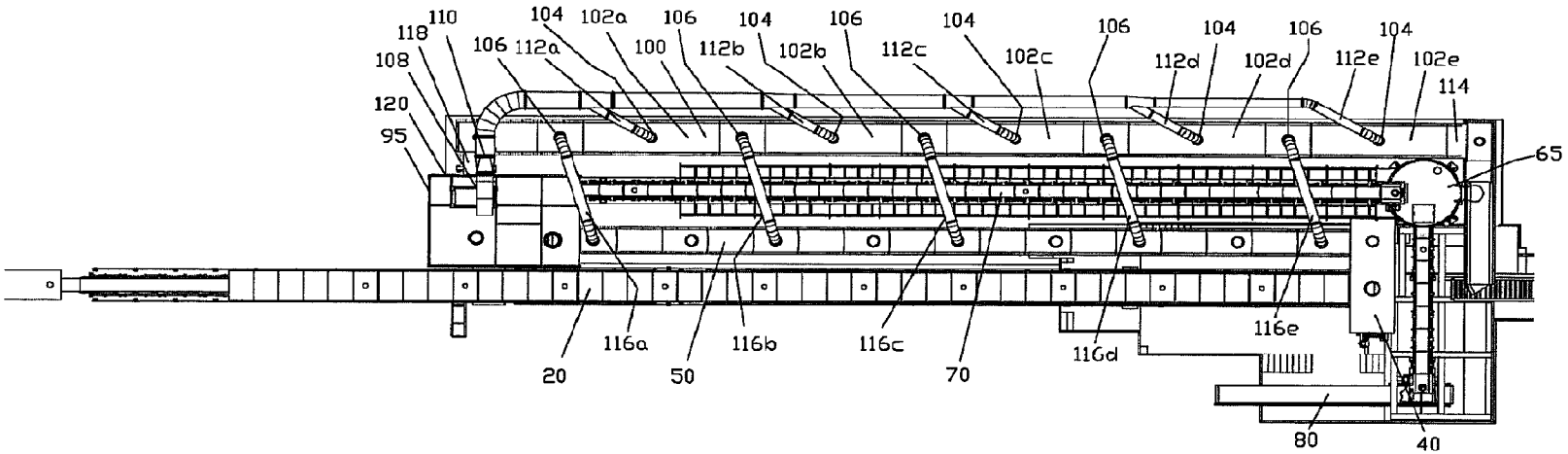
FIG. 2 is a schematic plan view of an embodiment of the method and system method of processing sand mold castings according to the present disclosure.

The castings (once free of the molding sand) are then conveyed along a first casting transfer conveyor 90 to the high velocity casting cooling conveyor 100. As also illustrated by FIG. 2, this conveyor section 100 includes high velocity exhaust hoods 102 to blow air on the castings at a controlled rate in specific zoned sections. The hoods 102 include inlet connections 104 and exhaust connections 106 located at spaced intervals along a process direction that are connected to an air duct system. In one embodiment, inlet 104 and exhaust connections 106 are provided along five meter intervals, although other intervals or spacings may be used without departing from the scope and intent of the present disclosure.

Air is provided by a commercial blower or fan 108 that produces high volumes of air through a primary duct line 110 (FIGS. 2-3) that is sectioned off along particular branch lines 112 and into the exhaust hoods 102 through the inlet connections 104. In one embodiment, as illustrated by FIG. 2, five branch lines 112*a*-112*e* supply five exhaust hoods 102*a*-102*e* along the casting cooling conveyor 100. The casting cooling conveyor section 100 includes specific air zones applying the air to the castings along the conveyor 100. The primary line 110 and branch lines 112 can include various cross sectional areas to allow various amount of air into each hood section 102*a*-102*e*. In one embodiment, the fan 108 is located on top of the housing 95.

Each air zone defined by each hood 102*a*-102*e* includes an exhaust air line 116 that extends from the associated exhaust connection 106. In one embodiment, the exhaust lines 116*a*-116*e* include a temperature measuring unit 122 to provide a signal to a controller 124 that is configured to adjust the blower 108 to provide a desired volume of air input by the blower to the casting cooling conveyor 100. Optionally, each branch line 112*a*-112*e* and each exhaust line 116*a*-116*e* can include a manual volume damper or an automatically adjustable volume damper that can be adjusted to modulate air volume control.

Figure 3:
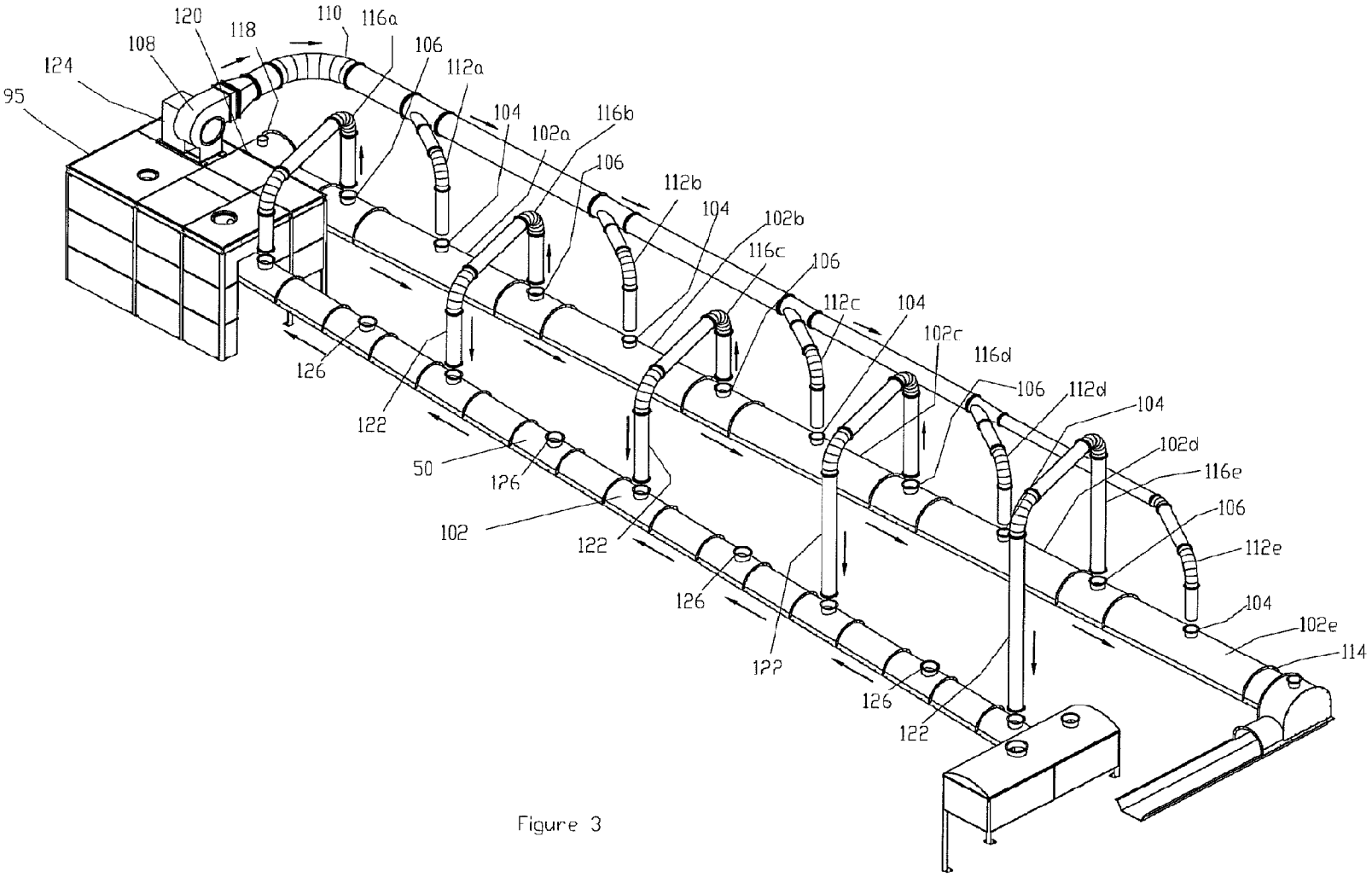
FIG. 3 is a perspective view of the system for processing sand mold castings according to the present disclosure.
Figure 4:
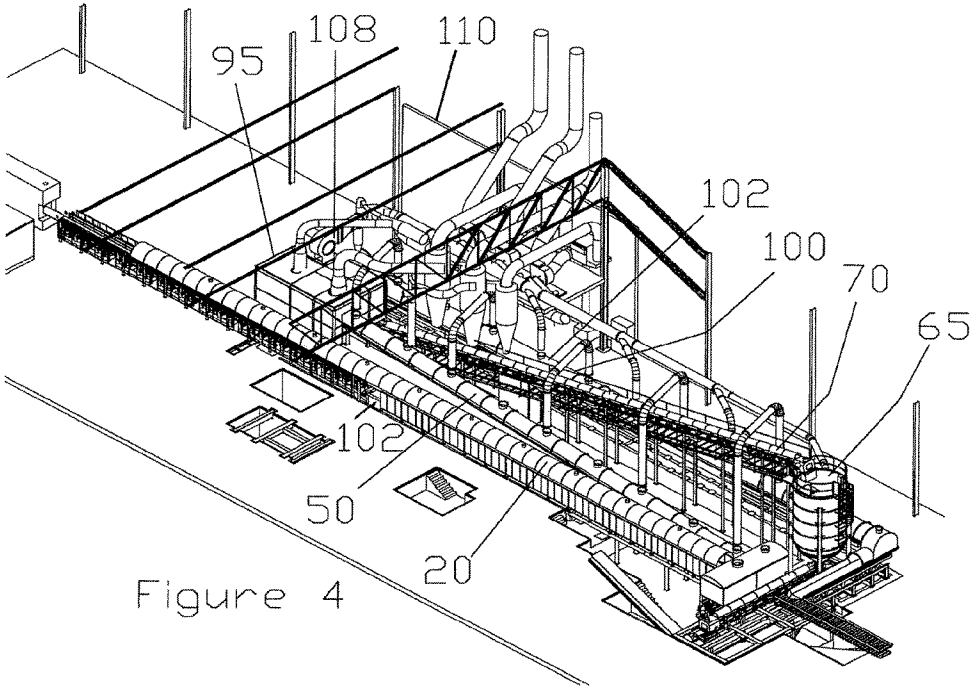
FIG. 4 a perspective view of the system for processing sand mold castings according to the present disclosure.

FIG. 3 illustrates a perspective plan view of one embodiment of the cooling system. The process reduces time for thermal break down of the molding sand and reduces the amount of moisture and temperature in its exhaust air. Directional arrows indicate the direction in which molds and castings travel along the conveyors 50, 100. Also, directional arrows indicate the direction that air is exhausted from the hoods 102 of the cooling conveyor 100 to the hoods 102 of the accumulating mold conveyor 50.

An electronic temperature sensor 118 for measuring a casting temperature is placed in close proximity to a discharge end 120 of the housing 95. Inputs from this sensor 118 will also be tied into the controller 124 to control the input air volume from the blower 108 to ensure the desired casting temperature is maintained. The casting cooling conveyor 100 can optionally include a curtain system 114 to prevent the unwanted exhaust of air along a discharge end of the cooling conveyor 100.

Exhaust air from the casting cooling conveyor 100 is regenerated in this system. The exhaust air from the casting cooling conveyor is dry hot air that is advantageously transferred into the hoods 102 that cover the accumulating mold conveyor 50 to absorb the moisture in the displaced air when the molds, still with the castings inside, are translated along the accumulating mold conveyor 50. Notably, air that has excessive moisture and/or heat cannot effectively be sent to a dust collection system. The high temperature dry recycled air as provided by the present arrangement will allow improved efficiency in moisture absorption and also the addition of the moist air will drop the temperature of the hot air. Air from the accumulating mold conveyor 50 is exhausted from a series of exhaust ports 126 located thereon. The exhaust ports 126 can be coupled to a series of ducts that are port of a buildings dust control and exhaust system (not shown for ease of illustration). The regeneration of the air will reduce the total air to be exhausted and thus reduce operational costs.

Figure 7:
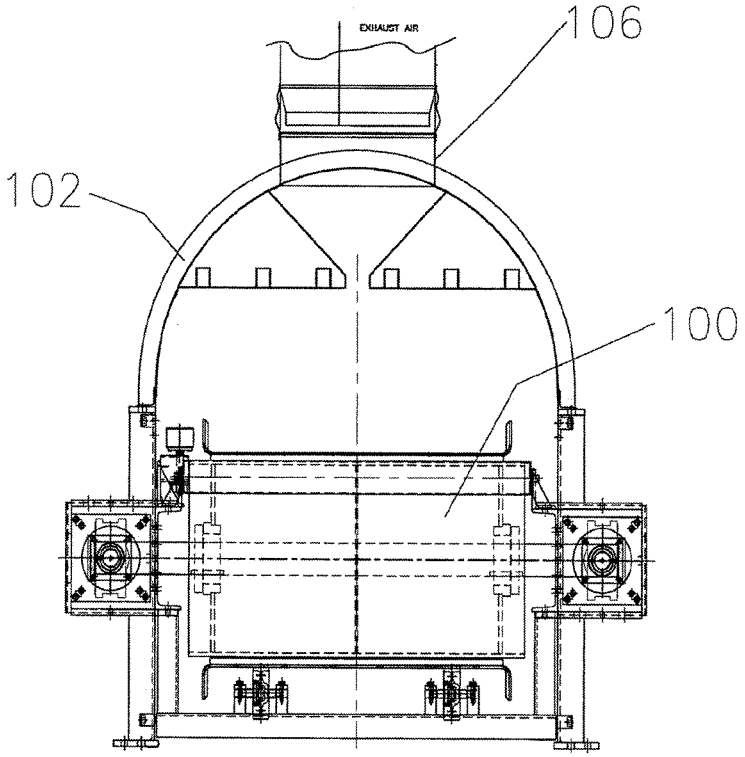
FIG. 7 is a cross-sectional view of the hood over a conveyor of the system for processing sand mold castings according to the present disclosure.

Stated another way, the fan 95 is used to produce high volumes of air that reduces the cooling time of cast metal parts once they are removed from the sand/molding media. The fan 95 injects ambient air into hoods 102 that cover the casting cooling conveyor 100 that are designed with an internal plenum that stores and accelerates the flow of the air to the surface of the conveyor that is transporting the cast parts. FIG. 7 illustrates a cross-sectional view of the hood 102 along the cooling conveyor 100.

Figure 5:
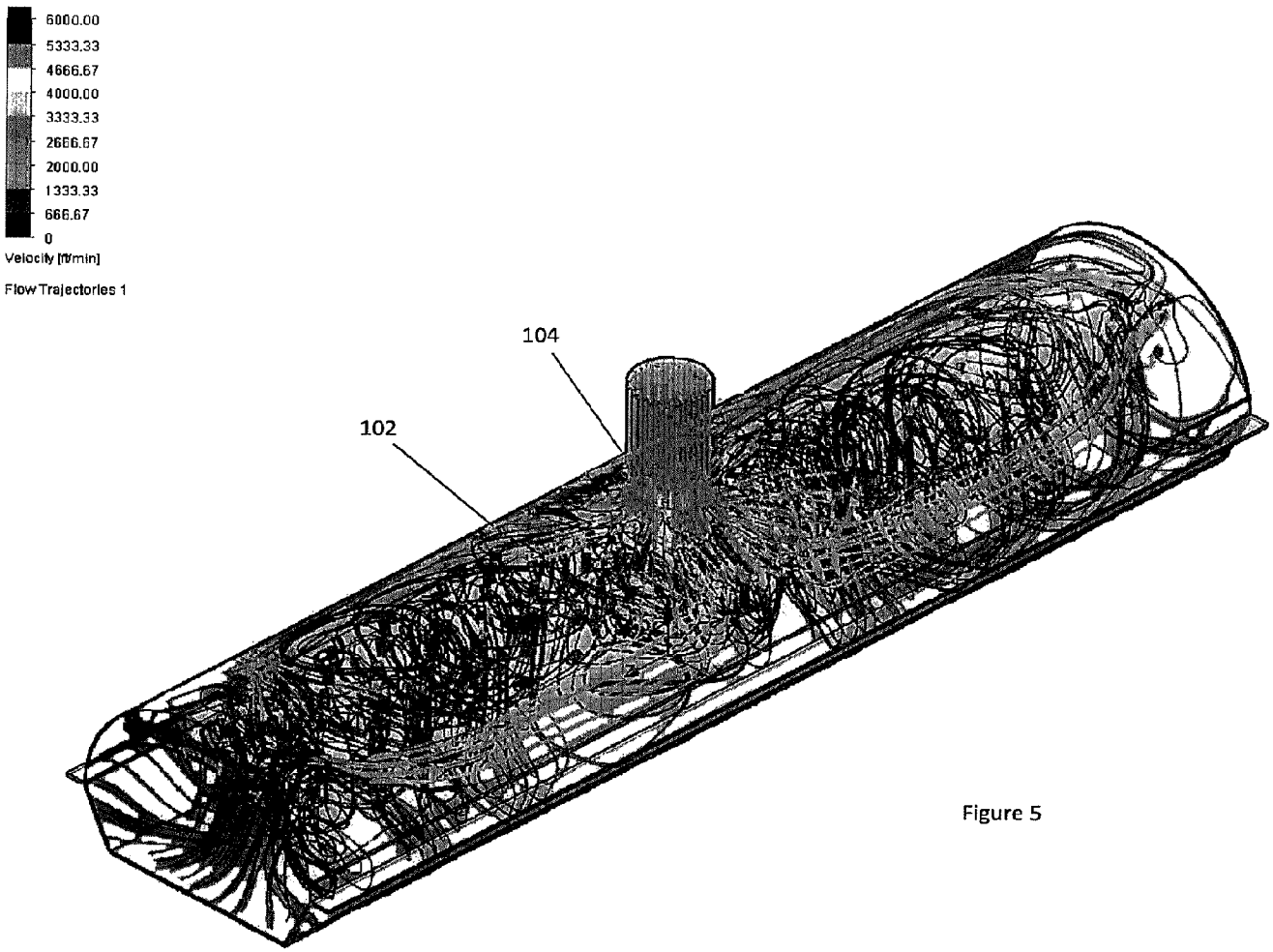
FIG. 5 is a perspective view of air velocity modeling within a hood of the system for processing sand mold castings according to the present disclosure.
Figure 6:
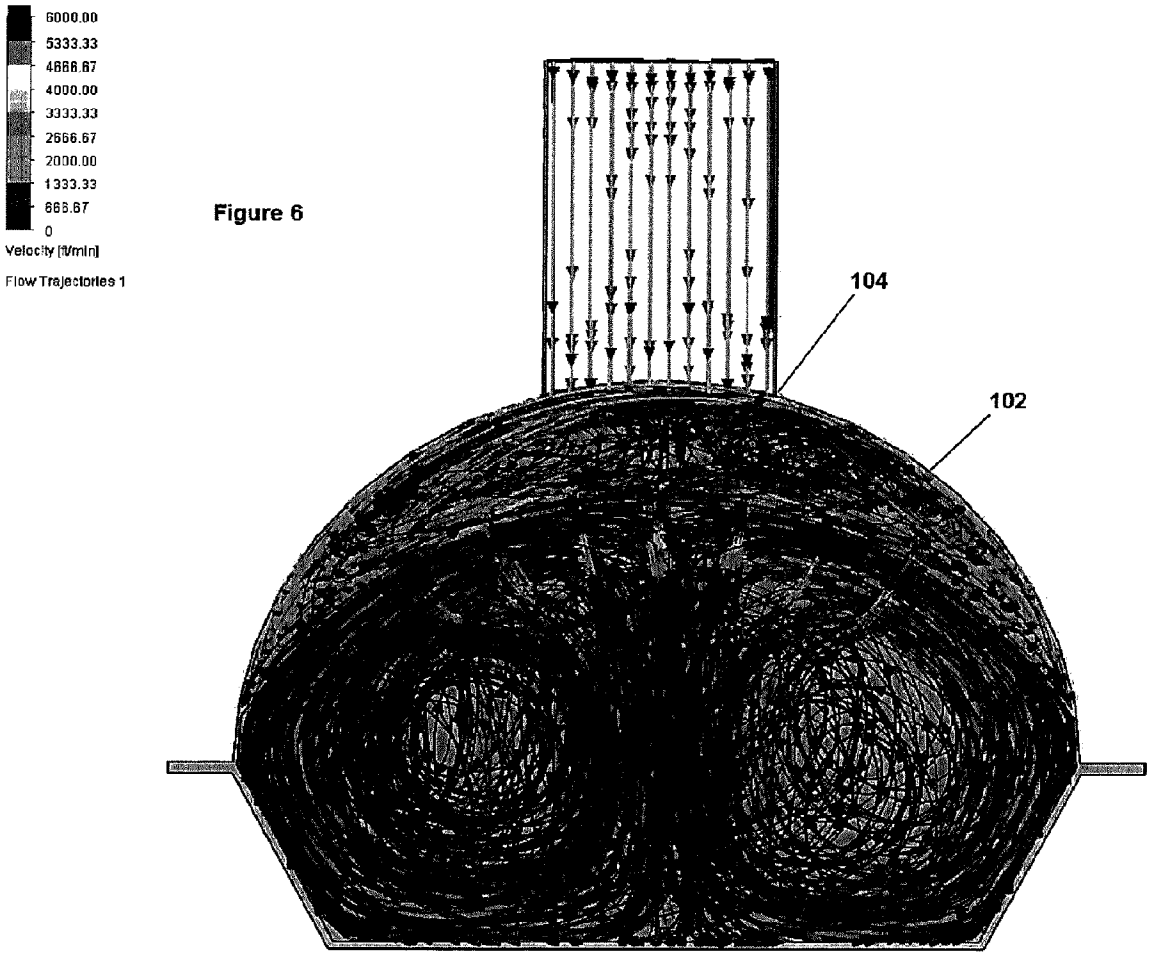
FIG. 6 is a cross-sectional view of air velocity modeling within a hood of the system for processing sand mold castings according to the present disclosure.

FIGS. 5 and 6 illustrate airflow modeling examples that identify vector stream lines through an inlet 104 and within a hood 102 of the disclosed system. As illustrated by FIG. 6, the cross sectional geometry of the hood 102 and the conveyor cause a dual wind tunnel cyclone effect at a location about the conveyor 100. The concentrated airflow includes rebounding and counter-flowing air across surfaces of the castings that cause rapid cooling of the cast components. Once the ambient air crosses the cast workpiece along the conveyor 100, the ambient air becomes a warm dry air that is exhausted through exhaust outlets 106 and through branch pipes 116 positioned along the conveyors 100.

Optionally, the hoods can be located at spaced intervals that are not continuous along the conveyor. The hoods 102 can have a staggered orientation such that each pressure reducing hood sections is spaced to allow exhausting of the air that has absorbed heat from the castings.

The exhaust air from the casting cooling conveyor 100 is warm and dry and is transferred via branch tube-pipes 116*a*-116*e* by its own thermal expansion and negative pressure from the casting cooling conveyor 100 to the mold accumulating conveyor 50. The air can optionally be transferred to the housing unit 95 or transport device that is downstream of the mold accumulating conveyor 50 or exhausted directly from the mold accumulating conveyor 50.

Notably, green sand molding processes utilize sand with natural binders that are activated by water. When the mold derogates and or is broken open after the molten material solidifies, there is a release of steam from the water/moisture in the sand due to the high temperature of the molten material. This wet, hot air causes a problem for dust collection and exhausting systems. However, by recirculating the hot dry air from the casting cooling conveyor 100 into the mold accumulation conveyor 50, the mold media/sand breaks down faster and the hot, wet exhaust air is mixed with warm dry air from the casting cooler conveyor 100 thus making the accumulation conveyor exhaust air acceptable for being processed by an exhaust system.

The disclosure has been described with reference to the preferred embodiments. Obviously, modifications and alterations will occur to others upon reading and understanding the preceding detailed description. It is intended that the exemplary embodiments be construed as including all such modifications and alterations insofar as they come within the scope of the appended claims or the equivalents thereof.

The invention claimed is:

1. A method of processing sand mold castings comprising:

placing a mold on a translation surface of a first conveyor at a first position, the mold including a sand housing having compacted sand that encapsulates a casting;

translating the mold along the translation surface of the first conveyor from the first position towards a second position;

removing the sand mold housing from the casting;

measuring the temperature of the casting after being removed from the sand mold;

moving the casting along a second conveyor downstream of the temperature measuring location;

directing air against the casting along the second conveyor to facilitate cooling of the casting; and transferring exhaust air that was previously directed against the casting along the second conveyor to the first conveyor that carries the sand housing mold encapsulating the casting, and directing the transferred exhaust air toward the sand housing mold.

2. The method of claim 1, further comprising adjusting the amount of air directed toward the casting.

3. The method of claim 2 wherein the adjusting step is responsive to the temperature measuring step.

4. The method of claim 1 wherein the directing step includes blowing high velocity air against the casting.

5. The method of claim 4 wherein the adjusting step is responsive to the temperature measuring step.

6. The method of claim 1 wherein the casting is removed from the sand and the sand is forwarded to a reprocessing center for reuse as a sand mold.

7. The method of claim 1 further comprising using high velocity hoods, over the conveyor to blow air on the castings at a controlled rate in specific zoned sections.

8. The method of claim 1 connecting zoned sections with a common air line.

9. The method of claim 1 further comprising exhausting air from the first conveyor through a series of exhaust ports spaced between the first and second positions.

10. The method of claim 1 wherein the exhaust air is transferred from the second conveyor to the first conveyor at discrete spaced locations along a travel path of the second conveyor.

11. The method of claim 10 wherein a first exhaust air line is located at a first position of the second conveyor and directs the exhaust air therefrom to a first region of the first conveyor, and a second exhaust air line is located at a second position of the second conveyor downstream of the first position and directs the exhaust air therefrom to a second region of the first conveyor upstream of the first region.

12. The method of claim 11 wherein each of the exhaust air lines includes a temperature measuring unit, and further comprising adjusting the amount of air directed toward the casting along the second conveyor.

13. The method of claim 11 further comprising measuring a temperature of the exhaust air directed against the casting along the second conveyor, and providing a signal to a controller, and the controller adjusting an air blower that directs the cooling air toward the casting along the second conveyor.

14. The method of claim 1 further comprising measuring a temperature of the exhaust air directed against the casting along the second conveyor, and providing a signal to a controller, and the controller adjusting an air blower that directs the cooling air toward the casting along the second conveyor.

15. The method of claim 1 further comprising directing air from an air blower to discrete first locations along the second conveyor, and transferring exhaust air from discrete second locations along the second conveyor wherein the first and second locations are interspersed in an alternating pattern along the second conveyor.

16. The method of claim 1 further comprising modulating the amount of air directed toward the casting by adjusting a damper.

* * * * *